United States Patent [19]

Mancuso

[11] Patent Number: 4,987,712

[45] Date of Patent: Jan. 29, 1991

[54] BRICK CLADDING ASSEMBLY

[75] Inventor: Noel A. M. Mancuso, Ingleburn, Australia

[73] Assignee: Empire Brick Pty Limited, Ingleburn, Australia

[21] Appl. No.: 353,767

[22] Filed: May 17, 1989

[51] Int. Cl.[5] ..... E04F 13/08; E04F 13/12

[52] U.S. Cl. ..... 52/387; 52/509; 52/87

[58] Field of Search ..... 52/387, 774, 712, 510, 52/386, 384, 509, 487

[56] References Cited

U.S. PATENT DOCUMENTS 2,043,706 6/1936 Myers ..... 52/387

3,387,422 6/1968 Wanzer ..... 52/387

*Primary Examiner*—James L. Ridgill, Jr.

*Attorney, Agent, or Firm*—James Markarian

[57] ABSTRACT

A brick cladding assembly including a metal strip from which there is punched a plurality of mounting flanges, the mounting flanges receive "brick" tiles which have side slots which receive the mounting flanges in order to secure the tiles to the mounting plate.

5 Claims, 5 Drawing Sheets

BRICK CLADDING ASSEMBLY

The present invention relates to brick cladding for buildings There are known several systems for applying a brick cladding to an existing wall surface or frame. These previous systems have included difficulties including problems associated with the installation of each brick tile, as well as failing to secure the brick tile in position. Still further, previously known systems have been generally time consuming in respect of the installation of the brick tiles.

It is the object of the present invention to overcome or substantially ameliorate the above disadvantages.

There is disclosed herein a mounting plate for a brick cladding assembly, which assembly includes a plurality of tiles to be supported by the plate, with each tile having a pair of parallel edge faces, and with each edge face having a slot so that the slots are parallel, said plate being of a generally planar rectangular configuration, and having a plurality of mounting flanges extending from the general plane of the plate and adapted to supportably engage the tiles by engagement within the slots thereof, and wherein the mounting flanges comprise two sets of flanges each set of flanges extending along a line so that the two lines of flanges are generally parallel, a first one of said sets including flanges with inclined flange portions projecting at an acute angle away from the general plane of the plate so that upon installation of one of the tiles thereon by location within one of the slots thereof, the flange portion is resiliently deformed to securely engage the tile when the other slot thereof is engaged with a corresponding one of the flanges of the other set.

A preferred form of the present invention will now be described by way of example with reference to the accompanying drawings, wherein.

Figure 1:
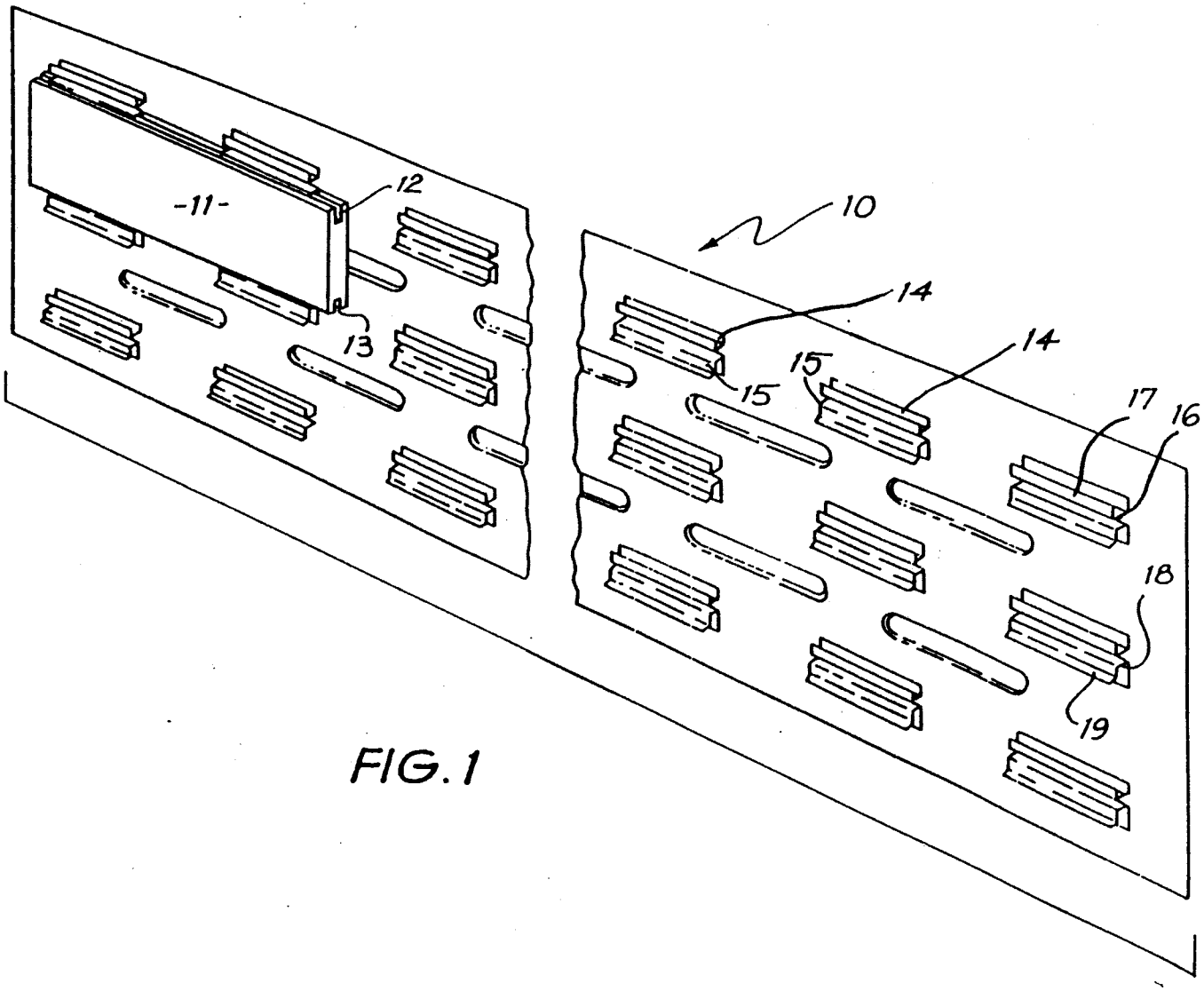
FIG. 1 is a schematic perspective view of a mounting plate of a brick cladding assembly.
Figure 2:
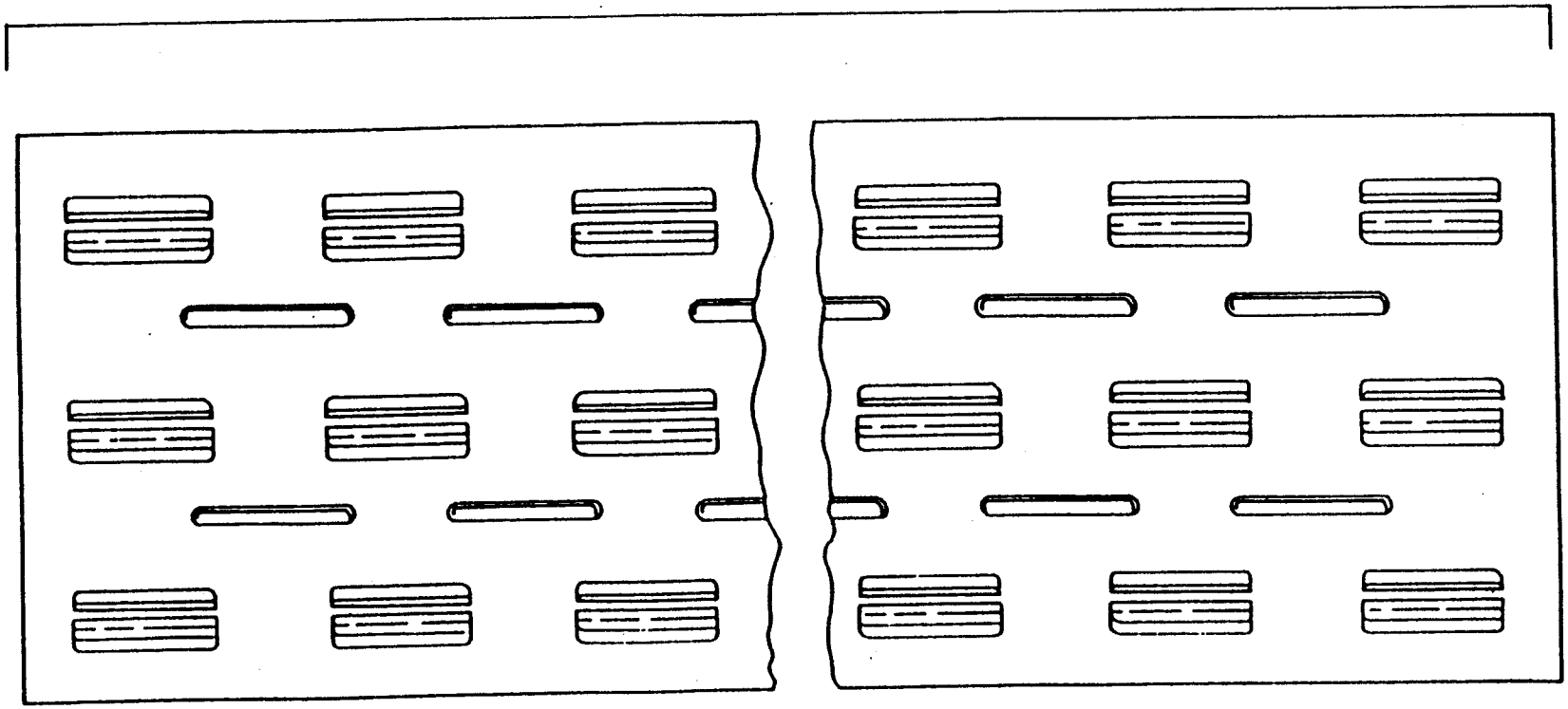
FIG. 2 is a schematic front elevation of the plate of FIG. 1.
Figure 3:
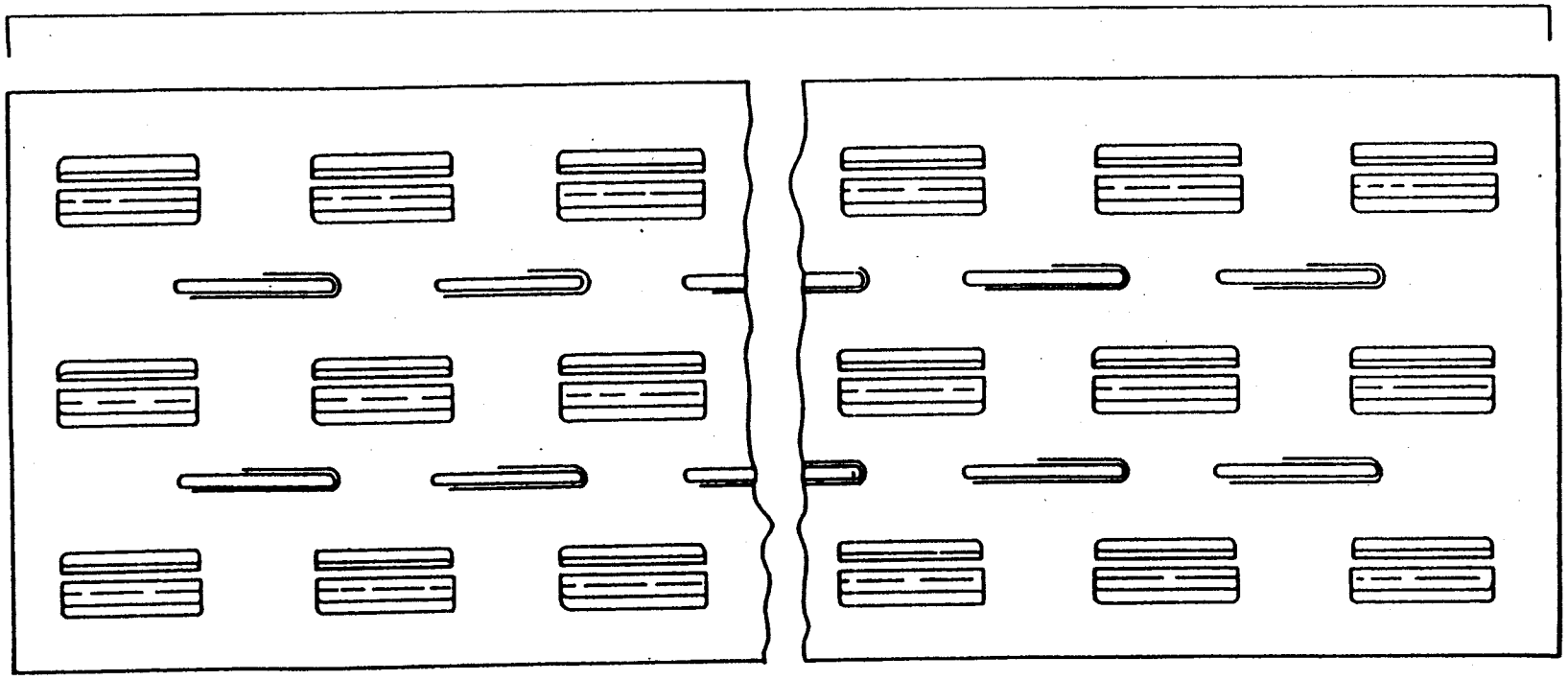
FIG. 3 is a schematic rear elevation of the plate of FIG. 1.
Figures 4, 5:
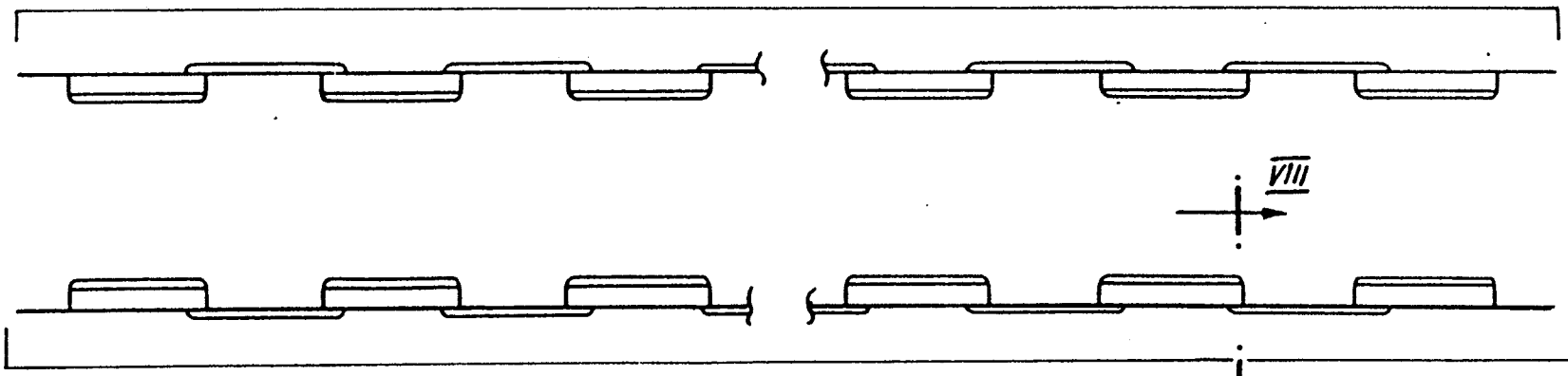
FIGS. 4 and 5 are schematic side elevations of the plate of FIG. 1.

In the accompanying drawings there is schematically depicted a mounting plate 10 for a brick cladding assembly. The mounting plate 10 is designed to be mounted on an existing wall surface, or alternatively upon a building frame. The mounting plate 10 is adapted to supportably receive a plurality of "brick" tiles 11.

The tiles 11 are manufactured from "face bricks" by having the face portion of the brick sawn therefrom so as to provide the tile 11. The longitudinal edges of the tile are further sawn so as to provide a pair of longitudinal slots 12 and 13.

The plate 10 is formed from a strip of metal (iron) which would preferably be treated to inhibit oxidising. The strip of iron is punched or otherwise deformed so as to have a plurality of flanges 14 and 15, with the flanges 15 providing a first set flanges, and the flanges 14 providing a second set of flanges. The set of flanges 14 are arranged in parallel rows as are the set of flanges 15. Still further, the flanges 14 and 15 are arranged in opposing pairs.

Figure 6:
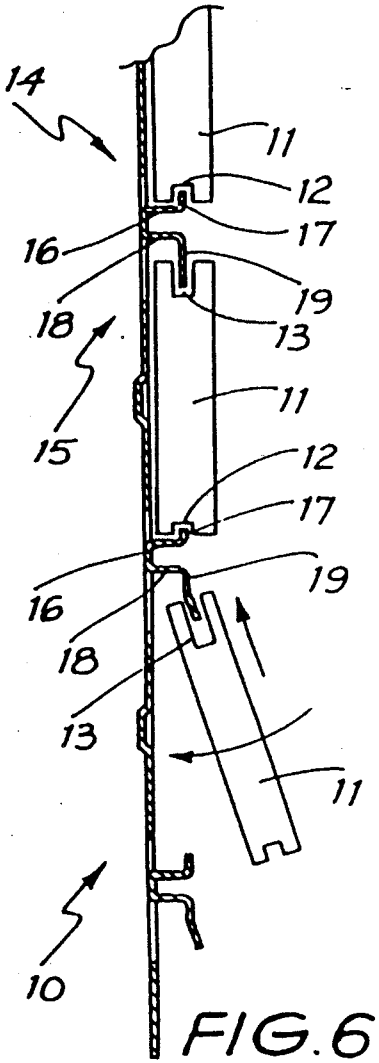
FIG. 6 is a schematic end elevation of the plate of FIG. 1.
Figure 8:
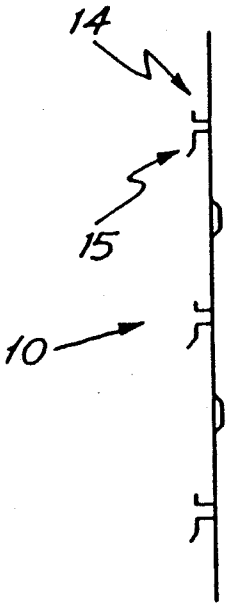
FIGS. 7 and 8 are schematic end elevations of the plate of FIG. 1.
Figure 7:
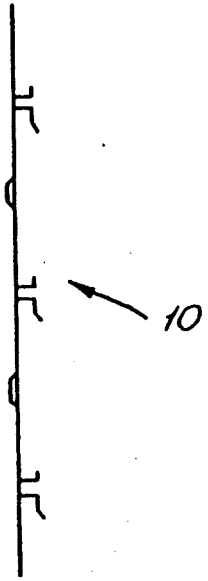

As best seen in FIGS. 6, 7 and 8, the flanges 14 are of an "L-shaped" configuration so as to have a base portion 16 projecting generally normal to the main plane of the plate 10, and a tile engaging lip 17 projecting generally parallel to the main plane of the plate 10. The flanges 15 each have a base portion 18 and a lip 19. The lip 19 first extends in a direction generally parallel to the plane of the plate 10, and then turns outward at an acute angle to the major plane of the plate 10.

In use of the plate 10, the plate 10 is fixed to the frame or surface of a building. The plate 10 is generally oriented in a vertical plane and has its longitudinal direction of extension generally horizontal. The tiles 11 are installed by first placing the slot 12 over the lip 19 of the flange or flanges 15 to support the tile 11. Thereafter, the tile 11 is pivotted towards the main body of the plate 10 deforming the lip 19 resiliently. The tile 11 once in a position adjacent the main body of the plate 10, has its slot 13 vertically aligned with the lip 17 of an associated flange 14. Thereafter, the tile 11 is moved downward so that the lip 17 is engaged within the slot 13.

By resiliently deforming the lip 19, the tile 11 is retained securely in position.

What I claim is:

1. A mounting plate for a brick cladding assembly, which assembly includes a plurality of tiles to be supported by the plate, with each tile having a pair of parallel edge faces, and with each edge face having a slot so that the slots are parallel, said plate being of a generally planar rectangular configuration, and having a plurality of mounting flanges extending from the general plane of the plate and adapted to supportably engage the tiles by engagement within the slots thereof, and wherein the mounting flanges comprise two sets of flanges, each set of flanges extending along a line so that the two lines of flanges are generally parallel, a first one of said sets including flanges to be engaged by the tile with inclined flange portions projecting at an acute angle away from the general plane of the plate so that upon installation of one of the tiles thereon by location within one of the slots thereof, the flange portion is resiliently deformed to securely engage the tile when the other slot thereof is engaged, after the flange of said one set, with a corresponding one of the flanges of the other set.

2. The mounting plate of claim 1, wherein the flanges of said first one of said sets, includes a first flange portion projecting generally normal to the plane of the plate, with said inclined flange portions extending from said first portions.

3. The mounting plate of claim 1, wherein the flanges of the other set of flanges to said one set of flanges, include a first flange portion extending generally normal to the plane of the plate, and a second flange portion extending towards said first one of said sets of flanges, and said inclined flange portions project towards said other set of flanges.

4. The mounting plate of claim 3, wherein said plate is formed of strip metal, and said flanges are punched therefrom.

5. A brick cladding assembly comprising the mounting plate of claim 4, and a plurality of said tiles mounted thereon.

* * * * *